United States Patent [19]

Hino et al.

[11] Patent Number: 4,591,667

[45] Date of Patent: May 27, 1986

[54] DOME SPEAKER WITH CUT-OUT PORTIONS IN THE VOICE COIL BOBBIN

[75] Inventors: Masanori Hino; Toshiji Kato; Tatsuya Omori, all of Hirakata, Japan

[73] Assignee: Onkyo Kabushiki Kaisha, Osaka, Japan

[21] Appl. No.: 706,493

[22] Filed: Feb. 28, 1985

[30] Foreign Application Priority Data

| | | | |
|---|---|---|---|
| Mar. 6, 1984 | [JP] | Japan | 59-32826[U] |
| Mar. 9, 1984 | [JP] | Japan | 59-34746[U] |
| Jun. 20, 1984 | [JP] | Japan | 59-91866[U] |

[51] Int. Cl.[4] ..... H04R 9/04; H04R 7/18; H04R 9/06

[52] U.S. Cl. ..... 179/115.5 ES; 179/115.5 VC; 179/181 R

[58] Field of Search ..... 179/115.5 ES, 115.5 R, 179/115.5 VC, 115 R, 181 R, 101; 181/168

[56] References Cited

U.S. PATENT DOCUMENTS

| | | | |
|---|---|---|---|
| 2,769,942 | 11/1956 | Hassan | 179/155.5 VC |
| 3,193,627 | 7/1965 | Hecht | 179/115.5 VC |
| 3,792,394 | 2/1974 | Bertagni | 179/115.5 VC |
| 4,057,694 | 11/1977 | Obuchi | 179/115.5 R |
| 4,118,605 | 10/1978 | Kobayashi | 179/115.5 VC |
| 4,225,757 | 9/1980 | Babb | 179/181 R |

FOREIGN PATENT DOCUMENTS

| | | | |
|---|---|---|---|
| 52-67612 | 6/1977 | Japan | 181/168 |
| 26967 | 8/1978 | Japan | 181/168 |
| 21088 | 7/1979 | Japan | 181/168 |
| 39159 | 10/1980 | Japan | 179/181 R |
| 57-93796 | 6/1982 | Japan | 179/115 R |
| 58-3500 | 1/1983 | Japan | 179/115 R |

*Primary Examiner*—Gene Z. Rubinson
*Assistant Examiner*—Danita R. Byrd
*Attorney, Agent, or Firm*—Webb, Burden, Robinson & Webb

[57] ABSTRACT

A structure for a dome speaker includes a dome-shaped diaphragm formed of a high rigidity material and having an outer periphery, a voice coil bobbin secured at a top end thereof to the outer periphery of the diaphragm, a voice coil mounted about the bobbin, and a variation means in the bobbin for varying the resonance conditions of the diaphragm. The variation means includes at least one cut-out portion provided at the top end of the bobbin and a sheet which closes the cut-out portion. Preferably, the diaphragm is made of a nitrified titanium alloy and the sheet is made from a material softer than the bobbin. The cut-out portion may have a width from about 7 to about 50 percent of the total circumferential length of the bobbin.

8 Claims, 13 Drawing Figures

DOME SPEAKER WITH CUT-OUT PORTIONS IN THE VOICE COIL BOBBIN

BACKGROUND OF THE INVENTION

This invention relates to a dome speaker.

As shown in FIGS. 12 and 13 of the accompanying drawings, the dome speaker of the prior art generally comprises a ring magnet 11', a center pole 12', a front plate 13', a back plate 14', a diaphragm 15', a voice coil 1' mounted on a voice coil bobbin 1a' secured to the outer periphery of the diaphragm 15' and disposed in a magnetic space between the center pole 12' and the front plate 13', and an edge 5' supporting the diaphragm 15'. The voice coil 1' is energized with audio currents to activate the diaphragm 15' whereby sound waves are radiated.

The diaphragm 15' is in most cases formed of hard metal such as duralumin and into dome shape as seen from FIGS. 12 and 13. The hard diaphragm of this type involves small mechaical internal loss in the diaphragm material in a frequency range higher than a piston vibration range. Therefore, vibrating energy conducted from peripheries of the diaphragm and the vibrating energy reverberated from the center of the diaphragm interface with each other thereby to create a nodal line adjacent the outer peripheries of the diaphragm. Since the vibrations of the diaphragm are in opposite phases across the nodal line, a dip is formed in the anti-resonance frequency in frequency characteristics, which dip is flanked by peaks in higher and lower frequency ranges. This deteriorates the frequency characteristics and transient characteristics to the deteriment of aural quality.

A further example of dome speaker, so-called soft dome speaker, employs for the diaphragm a soft material involving a great internal loss. Although this type of diaphragm is relatively free from resonance and anti-resonance, vibrating energy cannot easily be conducted through the diaphragm because of its large mass. Therefore, this type of speaker has the disadvantage of very poor efficiency of energy conversion.

SUMMARY OF THE INVENTION

Having regard to the disadvantages of the prior art noted above, this invention has for an object to provide a dome speaker having excellent frequency characteristics.

In order to achieve the above object a dome speaker according to this invention comprises a dome-shaped diaphragm formed of a high rigidity material, a voice coil bobbin carrying a voice coil, and variation means included in the voice coil bobbin for partially varying resonance conditions of the diaphragm.

The variation means in the voice coil bobbin for partially varying the rigidity of the diaphragm results in positional variations in stiffness at peripheries of the diaphragm. Therefore, no notable nodal line appears in the diaphragm in the anti-resonance frequency and peaks and dips in the frequency characteristics are scattered out. As shown in FIG. 4, the frequency characteristics represented by a solid line is more planar or level than the frequency characteristics of a known speaker represented by a dotted line. It will be clear that the speaker according to this invention has a greatly improved aural quality.

Moreover, since the diaphragm formed of a hard material is lighter than a soft dome diaphragm, its energy conversion efficiency is high. The dome speaker of this invention has excellent frequency characteristics never expected from the prior art.

A further object of this invention is to simplify the construction of the means for varying the vibrating conditions and permit the speaker to be manufactured at low cost thereby increasing its industrial utility.

In order to achieve this object, the variation means of this invention comprises cut-out portions defined in the top of the voice coil bobbin.

The portions of the diaphragm to which the top of the bobbin is attached have greater rigidity since the bobbin acts as a reinforcing rib therefor, and the portions of the diaphragm opposite the cut-out portions constitute smaller rigidity free ends that are planar or the like structures without any reinforcement. As a result the vibrations of the diaphragm are partially varied thereby providing for the excellent frequency characteristics. The improvement consists in such a simple construction that the cut-out portions are defined in the voice coil bobbin, which has the advantage of greatly lowering the manufacturing costs.

Other advantages of the invention will be apparent from the following description.

BRIEF DESCRIPTION OF THE DRAWINGS

The drawings show dome speakers embodying the present invention, in which.

DESCRIPTION OF THE PREFERRED EMBODIMENTS

(First Embodiment)

Figure 1:
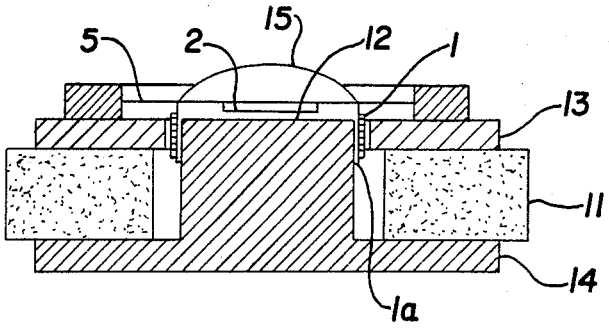
FIG. 1 is a side view in vertical section of a principal portion of a speaker according to a first embodiment of the invention.
Figure 12:
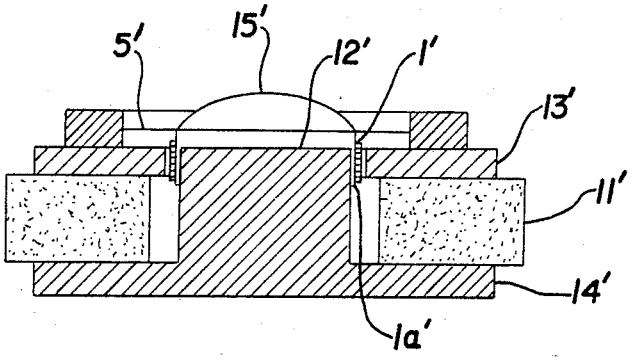
(PRIOR ART) FIG. 12
FIG. 12 is a side view in vertical section of a principal portion of a speaker according to the prior art.
Figure 13:
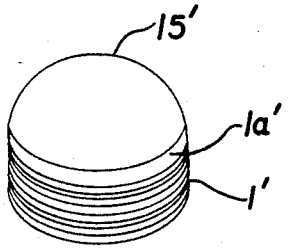
(PRIOR ART) FIG. 13
FIG. 13 is a perspective view of the principal portion of the known speaker.

Referring to FIG. 1, a dome speaker according to a first embodiment of the invention comprises a ring magnet 11, a center pole 12 disposed centrally of the ring magnet 11, a front plate 13 mounted on a top face of the magnet 11, a back plate 14 integral with the center pole 12 and disposed along a bottom face of the magnet 11, a dome-shaped duralumin diaphragm 15, a voice coil bobbin 1*a* secured to an outer periphery of the diaphragm 15 and disposed in a space between the center pole 12 and the front plate 13. A voice coil 1 is wound around the voice coil bobbin 1*a*. The diaphragm 15 is supported by an edge 5. The above arrangement per se is the same as the arrangement of the known dome speaker illustrated in FIGS. 12 and 13. The speaker according to the first embodiment differs from the known speaker in that the diaphragm structure according to the invention includes cut-out portions 2 in a top of the voice coil bobbin 1*a* acting as means to vary vibration frequency.

Figure 2:
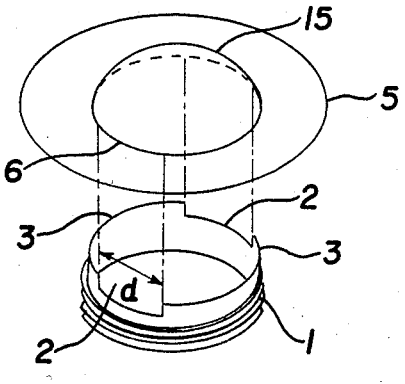
FIG. 2 is a developed perspective view of a diaphragm and a voice coil bobbin shown in FIG. 1.
Figure 3:
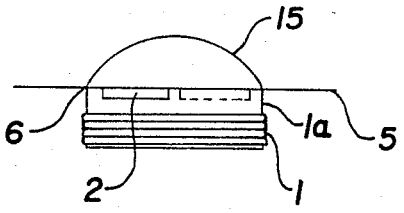
FIG. 3 is a side view of the diaphragm and voice coil bobbin.
Figure 4:
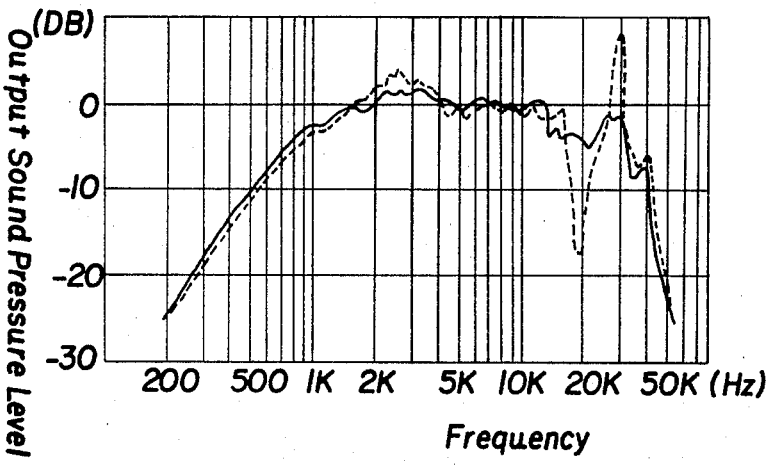
FIG. 4 is a graph showing frequency characteristics of the speaker according to the first embodiment.

More particularly, as shown in FIGS. 2 and 3, the bobbin 1*a* for the voice coil 1 defines cut-out portions 2 at two positions in the top. The cut-out portions 2 have a width d of the order of 7–50 percent of a total circumferential length of the bobbin 1*a*. The remaining top portions 3 of the bobbin 1*a* are attached to connections or boundaries 6 between the diaphragm 15 and the edge 5 which acts as a suspension for the diaphragm 15. Thus, the voice coil bobbin 1*a* is not connected to the diaphragm 15 at the cut-out portions 2.

The above construction wherein the voice coil bobbin 1*a* is partly connected to the diaphragm 15 results in vibrations at a center of the diaphragm 15 different from vibrations at outer peripheries thereof. That is to say the cut-out portions 2 function as means to partially vary the vibrations of the diaphragm 15.

The cut-out portions 2 may, of course, be provided at one or more positions. The width d and depth of the cut-out portions 2 are variable as desired.

Furthermore, the diaphragm 15 and the edge 5 may be an integral formation of one material or may be of two different materials joined together. Although not shown in the drawings, the connection between the diaphragm 15 and the edge 5 is also variable; for example, the edge 5 may comprise an upstanding portion or portions in an inner periphery thereof to which an outer periphery of the diaphragm 15 is attached, or alternatively both the outer periphery of the diaphragm 15 and the inner periphery of the edge 5 may comprise flat or horizontal portions adhearing to each other.

(Second Embodiment)

Figure 5:
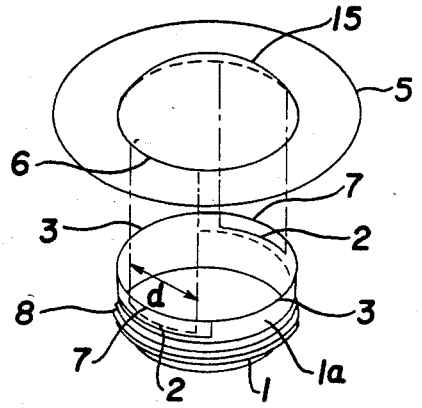
FIG. 5 is a developed perspective view of a principal portion of a speaker according to a second embodiment of the invention.
Figure 6:
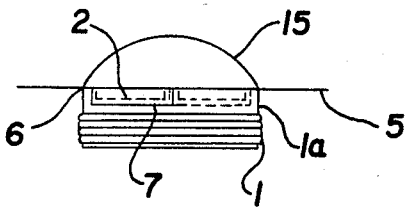
FIG. 6 is a side view of the principal portion shown in FIG. 5.

As shown in FIGS. 5 and 6, the frequency varying means comprises cut-out portions 2 at two positions in the top of the bobbin 1*a* of the voice coil 1, the cut-out portions 2 having a width d of the order of 7–50 percent of a total circumferential length of the bobbin 1*a*. The frequency varying means of the second embodiment further comprises sheets 7 closing the cut-out portions 2, the sheets 7 being formed of a softer material than a material of the bobbin 1*a*. The bobbin 1*a* is attached at the top 3 to the connection or boundary 6 between the duralumin diaphragm 15 and the edge 5 which acts as a suspension for the diaphragm 15. Thus, the voice coil 1 is weakly connected at the cut-out portions 2 to the diaphragm 15.

Figure 7:
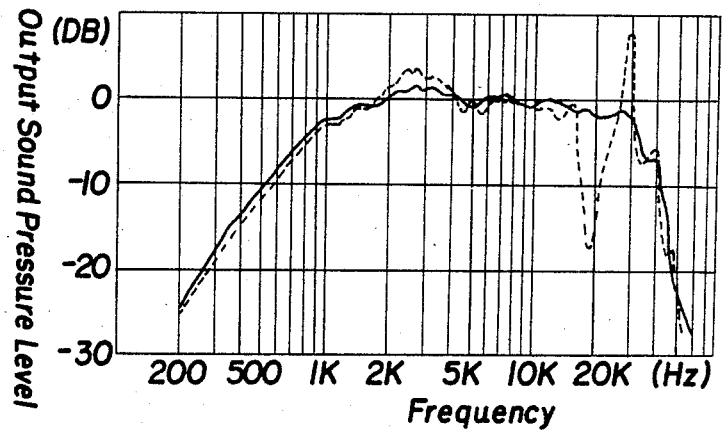
FIG. 7 is a graph showing frequency characteristics of the speaker according to the second embodiment.

FIG. 7 shows frequency characteristics of the diaphragm in the described construction which are represented by a solid line. As seen, the construction according to this embodiment of the present invention provides for planar characteristics than a conventional construction whose frequency characteristics are represented in FIG. 7 by a dotted line. This indicates a greatly improved aural quality according to this invention. In particular, the provision of the sheets 7 is effective to constrain anti-resonance in the vicinity of the cut-out portions 2.

(Third Embodiment)

Figure 8:
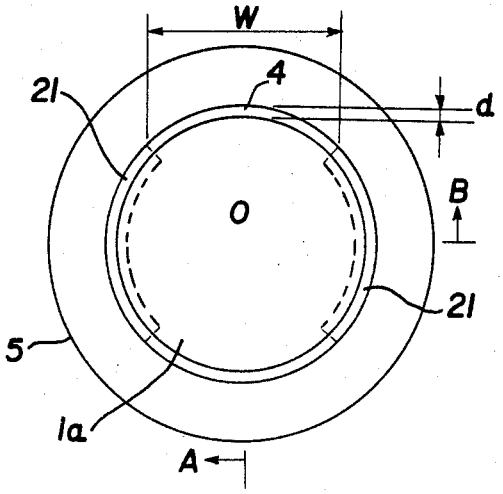
FIG. 8 is a plan view of a principal portion of a speaker according to a third embodiment of the invention.
Figure 9:
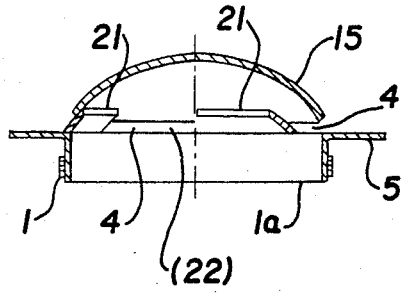
FIG. 9 is a side view in vertical section taken on line A-B of FIG. 8.
Figure 10:
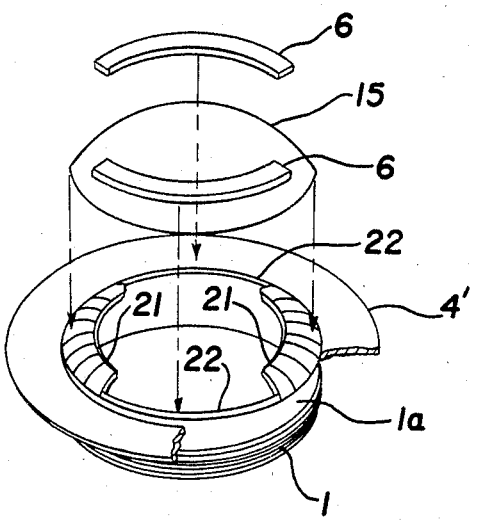
FIG. 10 is a developed perspective view of the speaker according to the third embodiment.

Referring to FIGS. 8 through 10, a voice coil bobbin 1*a* comprises a cylindrical body formed of a light and yet highly rigid material such as paper or cloth containing a metallic or other hard excipient or a synthetic resin reinforced with a high rigidity filler, said body being capable of high efficiency conduction of a driving force. The bobbin 1*a* carries a voice coil 1 wound around a lower end thereof, and extensions 21 at an upper end thereof. The extensions 21 have a curvature equal to that of the diaphragm 15 and have two segments 6 removed therefrom which define two cut-out portions 22 therebetween. As shown, these extensions 21 comprise portions of the bobbin 1*a* and are formed by cutting and bending. Alternatively, the extensions 21 may be formed by cup flow shaping.

The diaphragm 15 of this embodiment is formed of a light and yet highly rigid material such as paper or cloth containing a metallic or other hard excipient or a sythetic resin reinforced with a high rigidity filler, and has a smaller diameter than the voice coil 1. The diaphragm 15 is affixed to the extensions 21 of the voice coil bobbin 1*a*, and hence the diaphragm 15 and the voice coil bobbin 1*a* are joined together through the extensions 21, leaving clearance 4 at the cut-out portions 22. The cut-out portions 22 between the extensions 21 function as means to vary the vibration frequency.

Good test results have been obtained when the clearance 4 between the voice coil bobbin 1*a* and the diaphragm 15 has a clearance size d ranging from a minimum for maintaining outer peripheries of the diaphragm 15 and the voice coil bobbin 1*a* out of contact with each other to about 50 percent of a radius of the voice coil 1, and the cut-out portions 22 have a width W of the order of 3–50 percent of a total circumferential length of the voice coil bobbin 1*a*.

Figure 11:
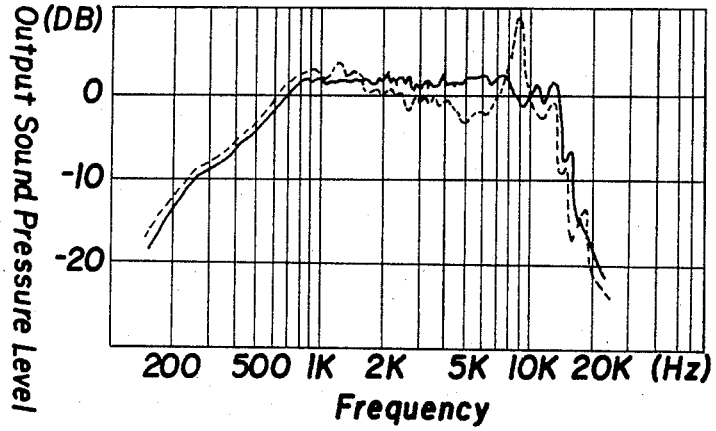
FIG. 11 is a graph showing frequency characteristics of the speaker according to the third embodiment.

FIG. 11 shows frequency characteristics of the dome speaker according to this embodiment as compared with those of a known speaker. In the subject embodiment, the diaphragm structure is formed of titanium and has a 60 mm diameter, the voice coil has a 65 mm diameter, the width W of the cut-out portions is about 46 mm, the clearance size d is 2.5 mm, and inner peripheries of a cloth edge are used as a viscoelastic substance. In FIG. 11, the frequency characteristics of this embodiment of a dome speaker are represented by a solid line and those of the known speaker are represented by a dotted line.

As seen, a sharp peak and dip occurs with the known speaker in the vicinity of 5–10 KHz which seems due to resonance and anti-resonance. With the speaker according to this embodiment, this peak and dip is scattered out to result in level frequency characteristics. Thus, it will be clear that the construction of the vibrating system according to this embodiment is very effective for excellent frequency characteristics of the dome speaker.

Particularly since the extensions 21 are flexible, a driving force is not conducted from the voice coil bobbin to the diaphragm in a high frequency range. Thus, as shown in FIG. 11, unnecessary sound radiation is shut off in the range of 13 KHz and higher. This shut-off range may be determined as desired by varying the bending degree of the extensions 21 thereby to select a suitable flexibility thereof.

The following advantages may be obtained by utilizing titanium as the diaphragm.

A titanium alloy has a higher Young's modulus than titanium per se and therefore increases the diaphragm rigidity which increases partial vibration frequency extending the range of piston vibration to the high frequency range. (In the case of Ti-6 Al-4 V alloy tensile strength increases by about 90 percent).

In the case of Titanium with nitrided surfaces, the surface layers have a very high Young's modulus which renders the diaphragm highly rigid and extends the range of piston vibration to the high frequency range. Furthermore, due to the internal loss in the inner layers the partial resonance is constrained thereby rendering the reproduction frequency range wide and flat.

In the case of a titanium alloy with nitrided surfaces, the diaphragm becomes even more rigid than in the above two cases, whereby the reproduction range extends to a higher frequency range and its frequency characteristics become flat.

What is claimed is:

1. A dome speaker comprising:

(a) a dome-shaped diaphragm formed of a high rigidity material and having an outer periphery;

(b) a voice coil bobbin secured at a top end thereof to the outer periphery of said diaphragm;

(c) a voice coil mounted about said bobbin; and (d) variation means in said voice coil bobbin for partially varying the resonance conditions of said diaphragm which includes at least one cut-out portion provided at the top end of said voice coil bobbin and a sheet closing said cut-out portion.

2. The dome speaker of claim 1 wherein said diaphragm further includes an edge portion integrally attached thereto along said outer periphery.

3. The dome speaker of claim 1 wherein said diaphragm is formed of a titanium alloy.

4. The dome speaker of claim 3 wherein said titanium alloy is nitrified.

5. The dome speaker of claim 1 wherein said diaphragm is formed of titanium.

6. The dome speaker of claim 5 wherein said titanium is nitrified.

7. The dome speaker of claim 1 wherein said sheet is formed of a material softer than said voice coil bobbin.

8. The dome speaker of claim 1 wherein the width of said cut-out portion is from about 7 to about 50 percent of the total circumferential length of said bobbin.

* * * * *